US007698888B2

(12) United States Patent
Wyatt

(10) Patent No.: US 7,698,888 B2
(45) Date of Patent: Apr. 20, 2010

(54) SYSTEM AND METHOD FOR CALCULATING LOADING OF A DIESEL PARTICULATE FILTER BY WINDOWING INPUTS

(75) Inventor: Sean C. Wyatt, Chicago, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 399 days.

(21) Appl. No.: 11/671,830

(22) Filed: Feb. 6, 2007

(65) Prior Publication Data

US 2008/0184696 A1 Aug. 7, 2008

(51) Int. Cl.
*F01N 3/00* (2006.01)

(52) U.S. Cl. ..... 60/295; 60/274; 60/286; 60/297; 701/102; 701/114; 700/271

(58) Field of Classification Search ..... 60/274, 60/285, 295, 297, 311, 286; 701/102, 114, 701/115; 700/271
See application file for complete search history.

(56) References Cited

U.S. PATENT DOCUMENTS

| | | | | |
|---|---|---|---|---|
| 4,492,079 | A * | 1/1985 | Takagi et al. | 60/274 |
| 7,159,392 | B2 * | 1/2007 | Kondoh et al. | 60/297 |
| 7,171,803 | B2 * | 2/2007 | Saito et al. | 60/297 |
| 7,231,291 | B2 * | 6/2007 | Dollmeyer et al. | 701/114 |
| 7,310,941 | B2 * | 12/2007 | Kuboshima et al. | 60/297 |

* cited by examiner

*Primary Examiner*—Binh Q. Tran
(74) *Attorney, Agent, or Firm*—Jack D. Nimz; Jeffrey P. Calfa

(57) ABSTRACT

An algorithm (26) in an engine control system (14) develops data indicative of pressure across a DPF (20) as a function of time and data indicative of flow rate through the DPF as a function of time, calculates derivatives (32, 30) (38, 36) with respect to time of the data, processes the derivatives (44, 42, 50, 48, 56, 54, 58) to confirm validity of a calculation of particulate loading of the DPF (load_pf) when a result of processing the derivatives discloses the absence of transient conditions in the DPF that would prevent the calculation from being valid and to not confirm validity of a calculation of particulate loading of the DPF when a result of processing the derivatives discloses the presence of transient conditions in the DPF that would prevent the calculation from being valid.

18 Claims, 3 Drawing Sheets

SYSTEM AND METHOD FOR CALCULATING LOADING OF A DIESEL PARTICULATE FILTER BY WINDOWING INPUTS

FIELD OF THE INVENTION

This invention relates generally to emission control systems in motor vehicles, such as trucks, that are powered by internal combustion engines, especially diesel engines that have exhaust gas treatment devices for treating exhaust gases passing through their exhaust systems.

BACKGROUND OF THE INVENTION

A known system for treating exhaust gas passing through an exhaust system of a diesel engine comprises a diesel oxidation catalyst (DOC) associated with a diesel particulate filter (DPF). The combination of these two exhaust gas treatment devices promotes chemical reactions in exhaust gas and traps diesel particulate matter (DPM) as exhaust flows through the exhaust system from the engine, thereby preventing significant amounts of pollutants such as hydrocarbons, carbon monoxide, soot, SOF, and ash, from entering the atmosphere.

A DPF requires regeneration from time to time in order to maintain particulate trapping efficiency. Regeneration can occur naturally when conditions are favorable, but can also be forced, such as when the particulate loading reaches a level that is deemed excessive because it is beginning to affect engine performance and/or trapping efficiency. Consequently, an engine control system typically calculates particulate loading from time to time to determine if regeneration needs to be forced.

Regeneration is forced by creating conditions that will burn off trapped particulates. The creation of conditions for initiating and continuing regeneration typically involves elevating the temperature of exhaust gas entering the DPF to a suitably high temperature. Because a diesel engine typically runs relatively cool and lean, the post-injection of diesel fuel can be used as part of the strategy to elevate exhaust gas temperatures entering the DPF while still leaving excess oxygen for burning the trapped particulate matter.

A known strategy for determining the amount of trapped particulates in a DPF (i.e. calculating the particulate loading) is based on pressure-flow relationships. For a given exhaust flow rate through a DPF, the difference between DPF inlet pressure and DPF outlet pressure is an indication of particulate loading.

It is believed fair to say that there is a general recognition among those familiar with DPF regeneration that it is desirable that a regeneration strategy minimize the frequency at which regeneration is forced, but when doing so that the strategy not significantly delay regeneration when conditions disclose that regeneration is needed.

When an engine is operating in a steady state condition, i.e. at a substantially constant speed and a substantially constant load, pressure across and flow through a DPF are substantially constant. Sufficiently accurate measurements of those parameters enable a sufficiently accurate calculation of particulate loading to be made.

However, the manner in which motor vehicles are driven results in their engines not always operating in steady state condition. While steady state operation can occur during certain driving situations such as highway cruising, acceleration and deceleration create transients in engine operation. Consequently, periodic calculation of DPF particulate loading may occasionally be made during transient operating conditions.

SUMMARY OF THE INVENTION

The present invention has been made in consequence of the observation of the effect of such transient operating conditions on pressure-flow characteristics pertaining to a DPF.

In particular the inventor has observed that during certain transients, volumetric flow through a DPF tends to change at a different rate from that at which the pressure across the DPF changes. If particulate loading is calculated during a transient that creates significant differences between those respective rates, significant error could be present in the calculation, and that could lead to either a premature or a delayed forced regeneration.

The inventive system and method provide a software solution for disclosing the presence of significant error in a calculation of particulate loading due to the calculation being made during transients where the exhaust flow rate through a DPF is changing at a significantly different rate from that at which the pressure across the DPF is changing.

One generic aspect of the invention relates to an internal combustion engine comprising an exhaust system comprising a diesel particulate filter (DPF) for trapping burnable particulates in engine exhaust passing through the exhaust system, and a control system comprising a processor for processing certain data relevant to calculating particulate loading of the DPF and for causing the creation of conditions that result in particulates trapped in the DPF being burned off when the processing of the certain data relevant to calculating particulate loading of the DPF calculates a valid data value for particulate loading that discloses a need for burning off trapped particulates.

The processor comprises an algorithm that, when executed to calculate particulate loading of the DPF a) calculates a derivative with respect to time of pressure across the DPF and a derivative with respect to time of rate of flow through the DPF, b) processes both of the calculated derivatives for compliance with a defined relationship between the two establishing validity of calculated particulate loading, and c) conditions validity of calculated particulate loading on disclosure of such compliance by the processing of the calculated derivatives.

Another generic aspect relates to a method for validating a calculation of particulate loading in a diesel particulate filter (DPF) in an exhaust system of an internal combustion engine having a control system including a processor for calculating particulate loading of the DPF and for causing the creation of conditions that result in particulates trapped in the DPF being burned off when a valid calculation of particulate loading of the DPF discloses a need for burning off trapped particulates.

The method comprises calculating particulate loading of the DPF, calculating a derivative with respect to time of pressure across the DPF and a derivative with respect to time of rate of flow through the DPF, processing the calculated derivatives for compliance with a defined relationship between the two establishing validity of calculated particulate loading, and conditioning validity of calculated particulate loading on the processing of the calculated derivatives disclosing compliance with the defined relationship between the two.

Still another generic aspect relates to an algorithm for conditioning validity of a calculation of particulate loading in a diesel particulate filter (DPF) in an exhaust system of an internal combustion engine having a control system including a processor for executing the algorithm and for causing the creation of conditions that result in particulates trapped in the DPF being burned off when a valid calculation of particulate loading of the DPF discloses a need for burning off trapped particulates.

The algorithm comprises calculating a derivative with respect to time of pressure across the DPF and a derivative with respect to time of rate of flow through the DPF, confirming validity of calculated particulate loading of the DPF by a result of processing the derivatives that discloses the absence of transient conditions in the DPF that would prevent the calculation from being valid and not confirming validity of calculated particulate loading of the DPF by a result of processing the derivatives that discloses the presence of transient conditions in the DPF that would prevent the calculation from being valid.

The foregoing, along with further features and advantages of the invention, will be seen in the following disclosure of a presently preferred embodiment of the invention depicting the best mode contemplated at this time for carrying out the invention. This specification includes drawings, now briefly described as follows.

DESCRIPTION OF THE PREFERRED EMBODIMENT

Figure 1:
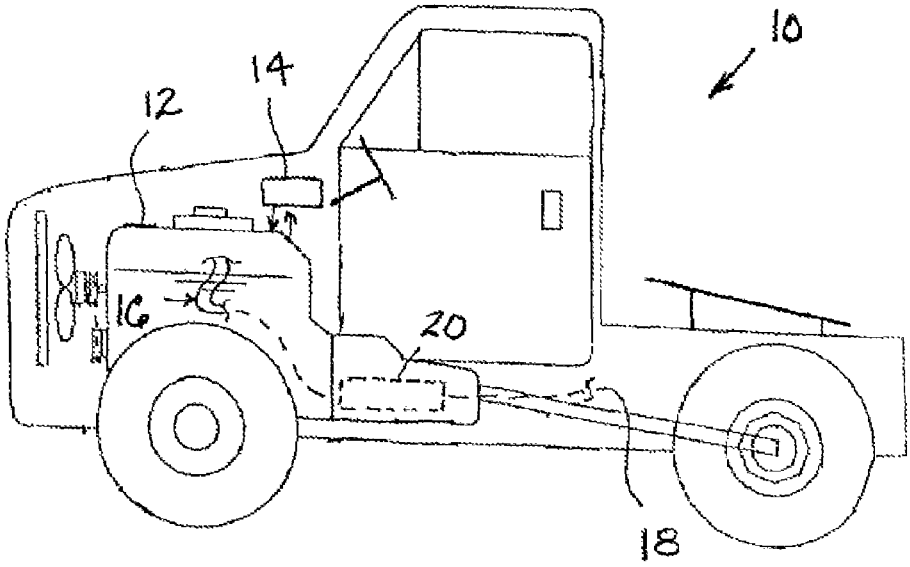
FIG. 1 shows portions of an engine in a motor vehicle relevant to the present invention.

FIG. 1 shows a truck 10 comprising a diesel engine 12 as the powerplant of the truck. Engine 12 has a processor-based engine control system 14 that processes data from various sources to develop various control data for controlling various aspects of engine operation. The data processed by control system 14 may originate at external sources, such as sensors, and/or be generated internally.

Engine 12 also has an exhaust system 16 through which exhaust created by combustion of a combustible mixture in combustion chambers of the engine is conveyed to a tail pipe 18 that opens to the surrounding atmosphere. Exhaust system 16 comprises one or more after-treatment devices, one of which is a diesel particulate filter (DPF) 20 that traps exhaust particulates so that they do not pass through to tail pipe 18.

Figure 2:
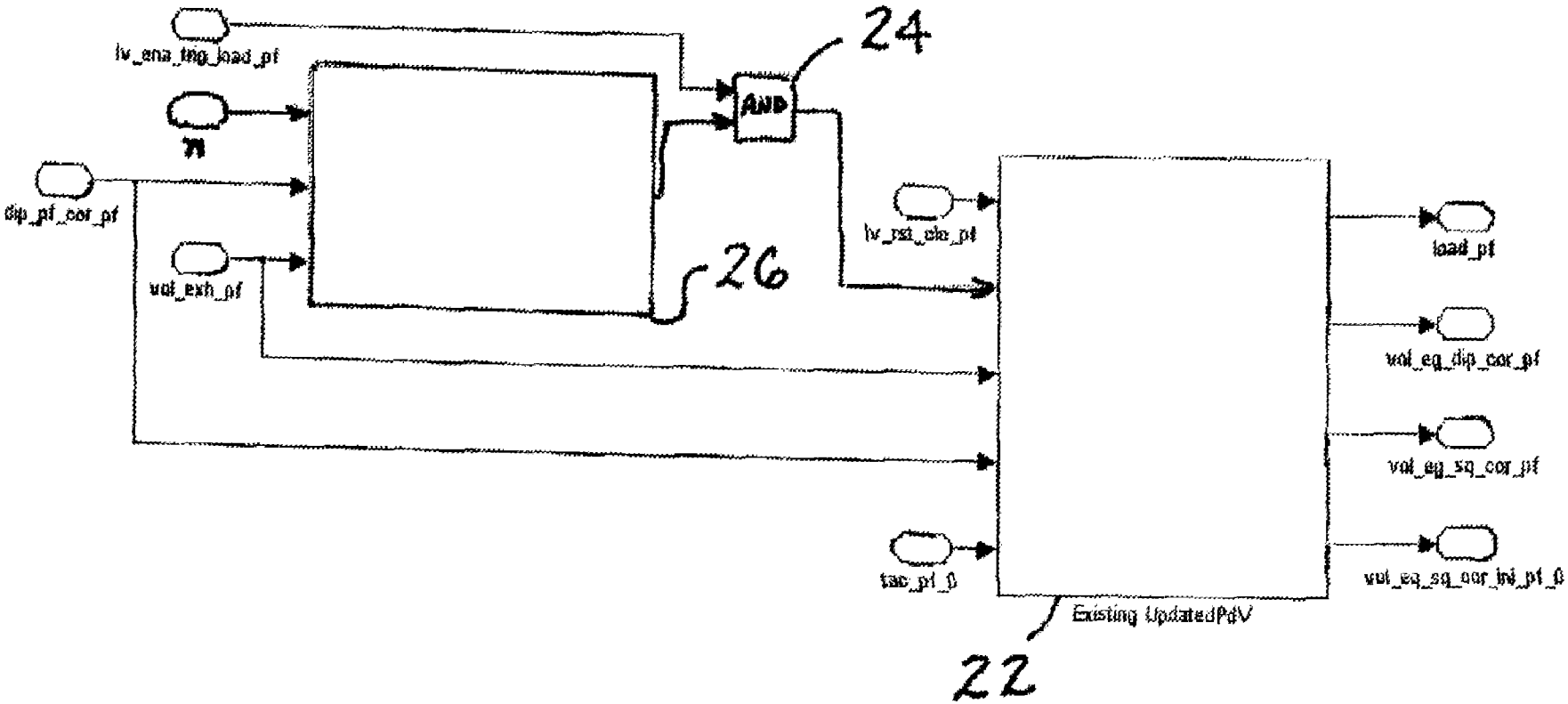
FIG. 2 is a general strategy diagram showing principles of the present invention.

As explained earlier, DPF 20 must be regenerated from time to time in order to purge it of trapped particulates. A need for regeneration is determined by control system 14 when an algorithm that is frequently executed discloses that the particulate load in DPF 20 has reached a defined value. FIG. 2 is a schematic block diagram representing the algorithm. The data value for a parameter load_pf represents the particulate loading.

A portion of the algorithm that is designated by a block 22 labeled Existing Updated PdV processes data values for respective parameters dip_pf_cor_pf and vol_exh_pf representing pressure across DPF 20 and exhaust flow rate through DPF 20 respectively. Data values for two other parameters lv_rst_clc_pf and tac_pf_0 are also processed by the algorithm of block 22. The processing performed by the algorithm of block 22 also yields data values for other parameters vol_eg_dip_cor_pf, vol_eg_sq_cor_pf, and vol_eq_sq_cor_ini_pf_0, but principles of the invention relate to the calculation of a data value for load_pf, and not to data values for vol_eg_dip_cor_pf, vol_eg_sq_cor_pf, and vol_eq_sq_cor_ini_pf_0. The parameter tac_pf_0 provides temperature compensation for the parameter vol_exh_pf which is based on volumetric flow rate developed by control system 14 using data obtained from a source not directly associated with the exhaust system where DPF 20 is located. The parameter lv_rst_clc_pf is used to reset the calculation when appropriate to do so.

Prior to the present invention, the data value for a parameter lv_ena_trig_load_pf was directly processed by the algorithm of block 22. That data value is binary in nature (i.e. a flag that turned on and off). It serves simply to enable the algorithm to calculate an updated value for load_pf when in one binary state and to unenable the calculation in the other binary state. When the flag enables a calculation, the calculation is therefore performed using the most recent data values for dip_pf_cor_pf and vol_exh_pf.

As mentioned earlier, the inventor has observed that during certain transients, the flow rate through a DPF tends to change at a different rate from that at which the pressure across the DPF changes. As a result, the correlation between flow and pressure drop that is suitable for calculating particulate loading during steady state conditions is poorly suited for use during transients and essentially unsuitable as transient behavior becomes more extreme. A graph plot of flow vs. pressure drop would show grossly disproportionate non-linear relationships.

If lv_ena_trig_load_pf happened to be set to the state enabling a calculation of load_pf during a transient where flow rate through the DPF was changing at a different rate from that at which the pressure across the DPF was changing, error could be introduced into the particulate loading calculation because of the transient. Significant differences between those respective rates, could cause the calculation to contain significant error, potentially causing either a premature regeneration or a delayed regeneration.

The invention provides a solution for minimizing and ideally eliminating such differences as a cause of error in the particulate loading calculation. Instead of allowing the data value for lv_ena_trig_load_pf to be processed directly by the algorithm of block 22, the processing is conditioned on at least the rate of change of pressure across DPF 20 and the rate of change of flow through DPF 20 being compliant with data defining proper relationship between rate of change of pressure across DPF 20 and rate of change of flow through DPF 20 for enabling a valid calculation of particulate loading to be made.

This is accomplished by including an AND logic function 24 that allows lv_ena_trig_load_pf to enable the calculation of a data value for load_pf only when an additional algorithm represented by a block 26 in FIG. 2 discloses that the rate of change of pressure across DPF 20 and the rate of change of flow rate through DPF 20 are compliant with data defining a proper relationship between them for enabling a valid calculation of load_pf to be made. In the disclosed embodiment, rate of change of engine speed is also a factor in determining if calculation of load_pf is to be enabled by the algorithm of block 26.

Data values representing engine speed (parameter n), pressure across DPF 20 (parameter dip_pf_cor_pf), and flow rate through DPF 20 (parameter vol_exh_pf) are processed by the algorithm of block 26. Detail of that processing will now be explained with reference to FIG. 3.

A first step in the processing involves determining that each of the three parameters is in a reasonably steady state condition. Doing so inherently confirms that proper relationship exists between rate of change of pressure across the DPF and rate of change of flow through the DPF for enabling a valid calculation of particulate loading to be obtained. Because certain engine speed transients may also affect accuracy of the particulate loading calculation, rate of change of engine speed is used to further condition enabling the particulate loading calculation.

Figure 3:
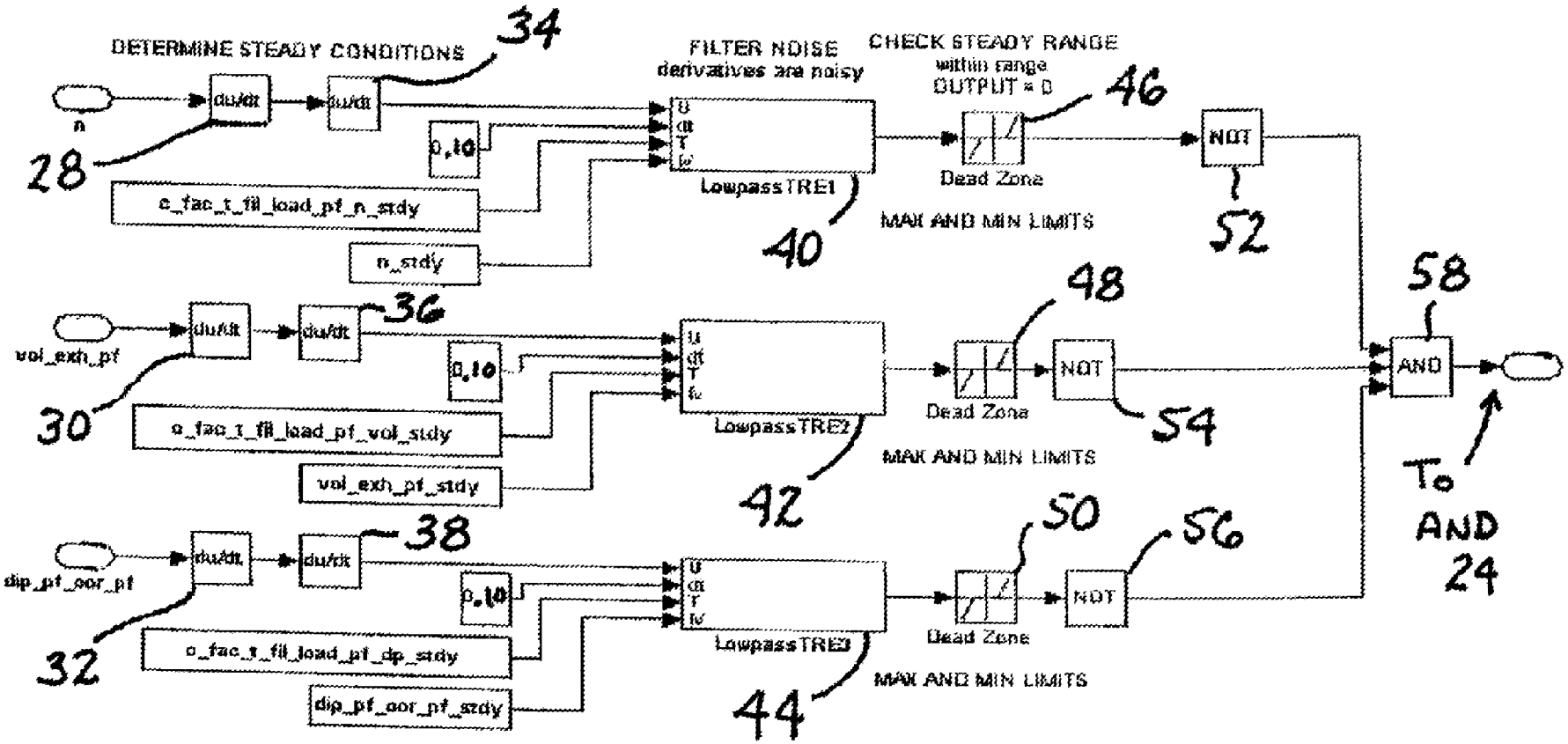
FIG. 3 shows more detail of a portion of the strategy shown in FIG. 2.

FIG. 3 shows that each parameter n, vol_exh_pf, and dip_pf_cor_pf is differentiated with respect to time by a respective function 28, 30, 32 to develop data representing rate of change of engine speed, rate of change of exhaust flow rate through DPF 20, and rate of change of pressure across DPF 20 respectively. A further derivative function 34, 36, 38 is then applied to develop rate of change of rate of change of engine speed (second derivative of engine speed), rate of change of rate of change of pressure across DPF 20 (second derivative of pressure), and rate of change of rate of change of flow rate through DPF 20 (second derivative of flow rate).

100 milliseconds is the time interval (dt) used in calculating the derivative functions. The algorithm is programmed with a corresponding parameter n_stdy, vol_exh_pf_stdy, dip_pf_cor_pf_stdy with which the applied second derivative of the respective parameter n, vol_exh_pf, dip_pf_cor_pf is compared in order to determine steady state compliance.

Steady state compliance is further conditioned by use of respective low-pass digital filter functions 40, 42, 44 to filter the results of comparing n and n_stdy, vol_exh_pf and vol_exh_pf_stdy, and dip_pf_cor_pf and dip_pf_cor_pf_stdy. The filter functions make those results substantially free of high-frequency noise. The time constant (T) for the respective function 40, 42, 44 is a respective programmed parameter c_fac_t_fil_load_pf_n_stdy, c_fac_t_fil_load_pf_vol_stdy, c_fac_t_fil_load_pf_dp_stdy.

The filtered data is then processed for compliance with functions 46, 48, 50 defining respective ranges having minimum and maximum limits, and validity of a data value calculation of particulate loading is confirmed when all filtered data is shown to be within range by three NOT (inverting) logic functions 52, 54, 56 that form inputs to an AND logic function 58 to cause the output that function 58 supplies to AND logic function to be a logic "1".

Conditioning the validity of a calculation of particulate loading by using the algorithm of block 26 that has been described in detail with reference to FIG. 3 to unenable the algorithm of block 22 when certain transient conditions are present, assures that substantially stable conditions exist at the time that the calculation is made. In that way a prior valid calculated value for particulate loading is maintained, and the introduction of error into a later calculation due to transient conditions in DPF 20 can be greatly diminished. The invention may be considered a sort of windowing that opens the calculation window when substantially stable conditions for relevant parameters are present and that closes the window when they are not.

Figure 4:
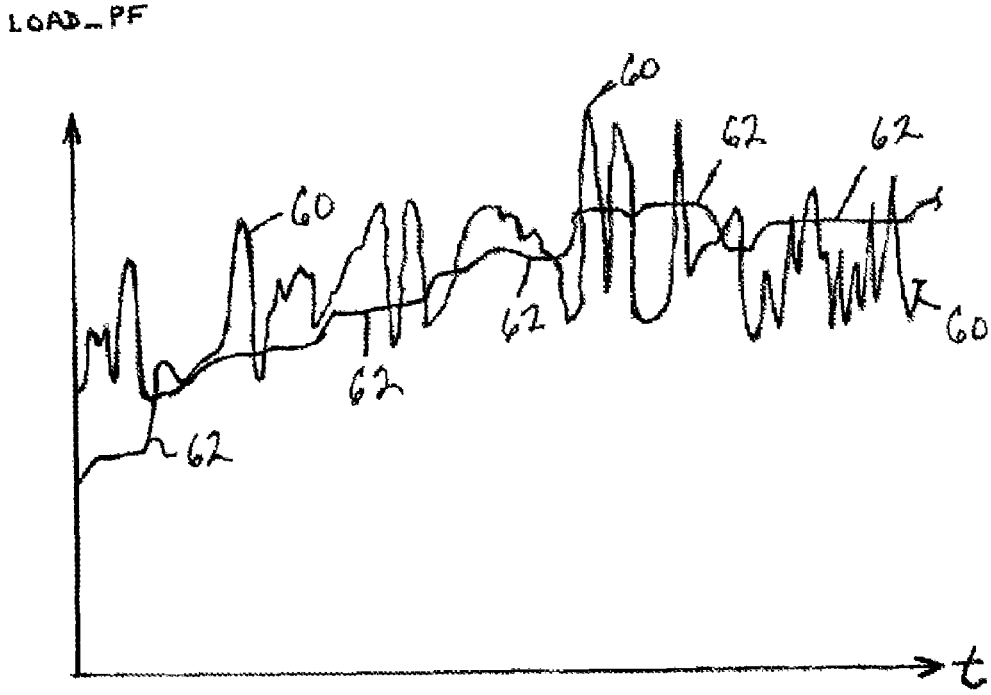
FIG. 4 is a graph plot containing respective traces for a parameter of interest with and without use of the invention.

FIG. 4 shows two traces 60, 62 of load_pf as a function of time t. Trace 60 represents particulate load calculations made over time in the presence of certain transients when the flag lv_ena_trig_load_pf directly enables the calculation by the algorithm of block 22. Trace 62 represents particulate load calculations made over time in the presence of the same transients when use of the flag lv_ena_trig_load_pf to enable the calculation by the algorithm of block 22 is conditioned as has been shown and described with reference to FIG. 2.

FIG. 4 shows that the extremes contained in trace 60 have been significantly attenuated by use of the invention, as represented by trace 62. The invention can allow accurate calculations to be made over substantially the full range of engine operation including idle, accelerations, decelerations, part-load, and full load.

While a presently preferred embodiment of the invention has been illustrated and described, it should be appreciated that principles of the invention apply to all embodiments falling within the scope of the invention that is generally described as follows.

What is claimed is:

1. An internal combustion engine comprising:

an exhaust system comprising a diesel particulate filter (DPF) for trapping burnable particulates in engine exhaust passing through the exhaust system;

a control system comprising a processor for processing certain data relevant to calculating particulate loading of the DPF and for causing the creation of conditions that result in particulates trapped in the DPF being burned off when the processing of the certain data relevant to calculating particulate loading of the DPF calculates a valid data value for particulate loading that discloses a need for burning off trapped particulates;

wherein the processor comprises an algorithm that, when executed to calculate particulate loading of the DPF a) calculates a derivative with respect to time of pressure across the DPF and a derivative with respect to time of rate of flow through the DPF, b) processes both of the calculated derivatives for compliance with a defined relationship between the two establishing validity of calculated particulate loading, and c) conditions validity of calculated particulate loading on disclosure of such compliance by the processing of the calculated derivatives.

2. An engine as set forth in claim 1 wherein the algorithm, when executed, also calculates a derivative with respect to time of engine speed for compliance with speed derivative reference data, and conditions validity of calculated particulate loading on the processing of the derivative with respect to time of engine speed disclosing compliance of the derivative with respect to time of engine speed with the speed derivative reference data.

3. An engine as set forth in claim 2 wherein the algorithm comprises a first low-pass filter function for attenuating high-frequency noise in data used to calculate the derivative with respect to time of pressure across the DPF, a second low-pass filter function for attenuating high-frequency noise in data used to calculate the derivative with respect to time of rate of flow through the DPF, and a third low-pass filter function for attenuating high-frequency noise in data used to calculate the derivative with respect to time of engine speed.

4. An engine as set forth in claim 3 wherein the algorithm further comprises a first in-range function for confirming that the noise-attenuated derivative with respect to time of pressure across the DPF is within a defined first range, a second in-range function for confirming that the noise-attenuated derivative with respect to time of rate of flow through the DPF is within a defined second range, and a third in-range function for confirming that the noise-attenuated derivative with respect to time of engine speed is within a defined third range, and the algorithm conditions validity of calculated particulate loading on each in-range function confirming that the respective noise-attenuated derivative is within the respective defined range.

5. An engine as set forth in claim 1 wherein the algorithm comprises a first low-pass filter function for attenuating high-frequency noise in data used to calculate the derivative with respect to time of pressure across the DPF, and a second low-pass filter function for attenuating high-frequency noise in data used to calculate the derivative with respect to time of rate of flow through the DPF.

6. An engine as set forth in claim 5 wherein the algorithm further comprises a first in-range function for confirming that the noise-attenuated derivative with respect to time of pressure across the DPF is within a defined first range, and a second in-range function for confirming that the noise-attenuated derivative with respect to time of rate of flow through the DPF is within a defined second range, and the algorithm conditions validity of calculated particulate loading on each in-range function confirming that the respective noise-attenuated derivative is within the respective defined range.

7. An engine as set forth in claim 1 wherein the algorithm, when executed, to calculate particulate loading of the DPF a) calculates the second derivative with respect to time of pressure across the DPF and the second derivative with respect to time of rate of flow through the DPF, b) processes the second derivatives for compliance with a defined relationship between the two establishing validity of calculated particulate loading, and c) conditions validity of calculated particulate loading on disclosure of such compliance by the processing of the second derivatives.

8. An engine as set forth in claim 7 wherein the algorithm, when executed, to calculate particulate loading of the DPF also calculates the first derivative with respect to time of engine speed, processes the first derivative with respect to time of engine speed for compliance with speed first derivative reference data, and conditions validity of calculated particulate loading on the processing of the first derivative with respect to time of engine speed disclosing compliance with the speed first derivative reference data.

9. A method for validating a calculation of particulate loading in a diesel particulate filter (DPF) in an exhaust system of an internal combustion engine having a control system including a processor for calculating particulate loading of the DPF and for causing the creation of conditions that result in particulates trapped in the DPF being burned off when a valid calculation of particulate loading of the DPF discloses a need for burning off trapped particulates, the method comprising:

calculating particulate loading of the DPF;

calculating a derivative with respect to time of pressure across the DPF and a derivative with respect to time of rate of flow through the DPF;

processing the calculated derivatives for compliance with a defined relationship between the two establishing validity of calculated particulate loading;

and conditioning validity of calculated particulate loading on the processing of the calculated derivatives disclosing compliance with the defined relationship between the two.

10. A method as set forth in claim 9 further comprising calculating a derivative with respect to time of engine speed, processing the derivative with respect to time of engine speed for compliance with speed derivative reference data, and conditioning validity of calculated particulate loading on the processing of the derivative with respect to time of engine speed disclosing compliance of the derivative with respect to time of engine speed with the speed derivative reference data.

11. A method as set forth in claim 10 further comprising attenuating high-frequency noise in data used in calculations of the three derivatives by using respective low-pass filter functions.

12. A method as set forth in claim 11 further comprising confirming that the noise-attenuated derivatives are within respective defined ranges, and also conditioning validity of calculated particulate loading on confirmation that each noise-attenuated derivative is within the respective defined range.

13. A method as set forth in claim 9 further comprising attenuating high-frequency noise in data used in calculations of the derivatives by using respective low-pass filter functions.

14. A method as set forth in claim 13 further comprising confirming that the noise-attenuated derivatives are within respective defined ranges, and conditioning validity of calculated particulate loading on confirmation that each noise-attenuated derivative is within the respective defined range.

15. A method as set forth in claim 9 wherein the step of calculating a derivative with respect to time of pressure across the DPF and a derivative with respect to time of rate of flow through the DPF comprises calculating the second derivative with respect to time of pressure across the DPF and the second derivative with respect to time of rate of flow through the DPF;

processing the second derivatives for compliance with a defined relationship between the two establishing validity of calculated particulate loading;

and conditioning validity of calculated particulate loading on the processing of the second derivatives disclosing compliance with the defined relationship between the two.

16. An algorithm for conditioning validity of a calculation of particulate loading in a diesel particulate filter (DPF) in an exhaust system of an internal combustion engine having a control system including a processor for executing the algorithm and for causing the creation of conditions that result in particulates trapped in the DPF being burned off when a valid calculation of particulate loading of the DPF discloses a need for burning off trapped particulates, the algorithm comprising:

calculating a derivative with respect to time of pressure across the DPF and a derivative with respect to time of rate of flow through the DPF, confirming validity of calculated particulate loading of the DPF by a result of processing the derivatives that discloses the absence of transient conditions in the DPF that would prevent the calculation from being valid and not confirming validity of calculated particulate loading of the DPF by a result of processing the derivatives that discloses the presence of transient conditions in the DPF that would prevent the calculation from being valid.

17. An algorithm as set forth in claim 16 wherein the step of calculating a derivative with respect to time of pressure across the DPF and a derivative with respect to time of rate of low through the DPF comprises calculating the second derivative with respect to time of pressure across the DPF and the second derivative with respect to time of rate of flow through the DPF, and the step of confirming validity of calculated particulate loading comprises using the second derivatives as the processed derivatives.

18. An algorithm as set forth in claim 17 wherein the step of confirming validity of calculated particulate loading also includes processing the first derivative with respect to time of engine speed to confirm validity of calculated particulate loading.

* * * * *